US006305382B1

(12) United States Patent
Hampl, Jr.

(10) Patent No.: US 6,305,382 B1
(45) **Date of Patent: *Oct. 23, 2001**

(54) REDUCED BASIS WEIGHT CIGARETTE PAPER

(75) Inventor: Vladimir Hampl, Jr., Roswell, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/420,698

(22) Filed: Oct. 19, 1999

Related U.S. Application Data

(63) Continuation-in-part of application No. 09/290,539, filed on Apr. 12, 1999, which is a continuation of application No. 08/833,579, filed on Apr. 7, 1997, now Pat. No. 5,893,372.

(51) Int. Cl.[7] ..... A24D 1/00; D21H 13/36

(52) U.S. Cl. ..... 131/165; 131/280; 131/360; 131/362; 162/181.1; 162/181.2; 162/181.4

(58) Field of Search ..... 131/365, 280, 131/360, 362, 364; 162/181.1, 181.2, 181.4

(56) References Cited

U.S. PATENT DOCUMENTS

| | | |
|---|---|---|
| 3,744,496 | 7/1973 | McCarty et al. . |
| 4,225,636 | 9/1980 | Cline et al. . |
| 4,318,959 | 3/1982 | Evans et al. . |
| 4,411,279 | 10/1983 | Martin et al. . |
| 4,420,002 | 12/1983 | Cline . |
| 4,453,553 | 6/1984 | Cohn . |
| 4,461,311 | 7/1984 | Mathews et al. . |
| 4,480,644 | 11/1984 | Luke . |
| 4,503,118 | 3/1985 | Murakami et al. . |
| 4,505,282 | 3/1985 | Cogbill et al. . |
| 4,548,677 | 10/1985 | Schneider et al. . |

(List continued on next page.)

FOREIGN PATENT DOCUMENTS

| | | |
|---|---|---|
| 135218 | 11/1949 | (AU) . |
| 0133575A1 | 2/1985 | (EP) . |
| 0133575 * | 2/1985 | (EP) . |
| 0133575B1 | 2/1985 | (EP) . |
| 0338159A1 | 10/1989 | (EP) . |
| 0375844A | 7/1990 | (EP) . |
| 0458526A1 | 11/1991 | (EP) . |
| 0533423A1 | 3/1993 | (EP) . |
| 2209267 | 5/1989 | (GB) . |
| 0066599 | 4/1984 | (JP) . |
| 1194298 | 8/1985 | (JP) . |
| 299699 | 10/1988 | (JP) . |
| 01268764 | 10/1989 | (JP) . |
| 405279993 | 10/1993 | (JP) . |
| 405279994 | 10/1993 | (JP) . |
| 249932 | 8/1969 | (SU) . |
| 249933 | 8/1969 | (SU) . |

*Primary Examiner*—James Derrington
*Assistant Examiner*—Carlos Lopez
(74) *Attorney, Agent, or Firm*—Dority & Manning, P.A.

(57) ABSTRACT

The present invention is generally directed to low weight cigarette wrapping papers. In particular, the wrapping papers, although having a low basis weight, have an opacity of at least 70% and a tensile strength comparable with conventional papers. Wrapping papers made according to the present invention contain a white pigment having a medium particle size of from 0.1 microns to about 0.5 microns. In one embodiment, a black pigment can also be combined with the white pigment in small amounts.

32 Claims, 1 Drawing Sheet

U.S. PATENT DOCUMENTS

| | | | | |
|---|---|---|---|---|
| 4,725,318 | | 2/1988 | Minayoshi et al. . | |
| 4,732,748 | | 3/1988 | Stewart et al. . | |
| 4,779,631 | * | 10/1988 | Mathews et al. | 131/365 |
| 4,805,644 | | 2/1989 | Hampl, Jr. et al. . | |
| 4,984,589 | | 1/1991 | Riedesser . | |
| 4,986,285 | | 1/1991 | Radzio et al. . | |
| 4,998,543 | | 3/1991 | Goodman et al. . | |
| 5,050,622 | | 9/1991 | Raker et al. . | |
| 5,060,675 | | 10/1991 | Milford et al. . | |
| 5,074,321 | | 12/1991 | Gentry et al. . | |
| 5,103,844 | | 4/1992 | Hayden et al. . | |
| 5,105,835 | | 4/1992 | Drewett et al. . | |
| 5,107,864 | | 4/1992 | Owens, Jr. . | |
| 5,107,866 | | 4/1992 | Aronoff et al. . | |
| 5,109,876 | | 5/1992 | Hayden et al. . | |
| 5,143,098 | | 9/1992 | Rogers et al. . | |
| 5,144,967 | | 9/1992 | Cartwright et al. . | |
| 5,152,304 | | 10/1992 | Bokelman et al. . | |
| 5,156,719 | | 10/1992 | Passaretti . | |
| 5,161,551 | | 11/1992 | Sanders et al. . | |
| 5,168,884 | | 12/1992 | Baldwin et al. . | |
| 5,172,708 | | 12/1992 | Drewett et al. . | |
| 5,215,734 | | 6/1993 | Kunesh et al. . | |
| 5,227,025 | | 7/1993 | Kunesh et al. . | |
| 5,228,464 | | 7/1993 | Owens, Jr. . | |
| 5,253,660 | | 10/1993 | Dixit et al. . | |
| 5,263,500 | | 11/1993 | Baldwin et al. . | |
| 5,271,419 | | 12/1993 | Arzonico et al. . | |
| 5,302,437 | | 4/1994 | Idei et al. . | |
| 5,307,823 | | 5/1994 | Jones et al. . | |
| 5,322,076 | | 6/1994 | Brinkley et al. . | |
| 5,327,916 | | 7/1994 | Jones et al. . | |
| 5,342,485 | | 8/1994 | Armbrust, Jr. . | |
| 5,360,023 | | 11/1994 | Blakley et al. . | |
| 5,385,158 | | 1/1995 | Owens, Jr. . | |
| 5,404,890 | | 4/1995 | Gentry et al. . | |
| 5,417,228 | | 5/1995 | Baldwin et al. . | |
| 5,450,862 | | 9/1995 | Baldwin et al. . | |
| 5,450,863 | | 9/1995 | Collins et al. . | |
| 5,830,318 | | 11/1998 | Snow et al. . | |
| 5,888,348 | | 3/1999 | Hampl, Jr. . | |
| 5,893,372 | | 4/1999 | Hampl, Jr. . | |

* cited by examiner

REDUCED BASIS WEIGHT CIGARETTE PAPER

RELATED APPLICATIONS

The present application is a continuation in part application of U.S. patent application Ser. No. 09/290,539 filed on Apr. 12, 1999, which is a continuation of U.S. Ser. No. 08/833,579 issued as U.S. Pat. No. 5,893,372 filed Apr. 7, 1997 and which is incorporated herein by reference in its entirety.

FIELD OF THE INVENTION

The present invention is generally directed to reduced basis weight wrapping papers for use in smoking articles and to a method of producing the wrapping papers. More particularly, the present invention is directed to a wrapping paper that contains white pigments and optionally black pigments possessing a sufficient particle size that effectively both scatter and absorb light for maintaining an opacity and tensile strength within commercially acceptable ranges, while decreasing the basis weight of the wrapping papers.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fiber and contain a filler, such as calcium carbonate.

Besides being used to hold the cigarette together, cigarette wrapping papers and tipping papers also contribute to and control many physical properties and characteristics of the cigarette. For instance, cigarette wrapping paper affects the rate at which the cigarette burns, the number of puffs per cigarette and the total tar delivery per puff. Another property of the cigarette that is affected by the wrapper is the appearance and the characteristics of the ash that is formed as the cigarette burns. Cigarette paper can even be used to limit the amount of smoke that emanates from the lit end of a cigarette when it is left burning and to reduce the tendency of a cigarette to ignite adjacent surfaces.

In the past, wrapping paper opacity was determined primarily as a function of the amount of filler incorporated into the papers. In general, opacity levels are increased as the amount of filler added to the paper is increased. Unfortunately, however, increasing filler levels to increase opacity can adversely affect other characteristics of the paper. For example, increasing filler levels can decrease the strength of the paper. Altering filler levels can also affect the permeability of the paper which may in turn affect the burn properties of the paper. As such, there is increasing pressure within the industry to keep filler levels in cigarette paper within preset ranges, severely restricting viable methods for increasing paper opacity.

Currently, focus has also been placed upon decreasing the basis weight of wrapping papers in order to decrease the amount of material needed to produce the papers. By reducing the basis weight of wrapping papers, however, two problems can result. First, by reducing the basis weight, the opacity of the wrapping paper is simultaneously decreased causing the paper to aesthetically decline in appearance by unmasking the cigarette's contents. Decreasing the basis weight of the wrapping papers also can cause a decrease in the tensile strength of the paper.

Due to the above limitations, it has been extremely difficult to create a wrapping paper with a decreased basis weight while maintaining an opacity and tensile strength level that is commercially acceptable.

Thus, a need exists for a wrapping paper for smoking articles that has a decreased basis weight while at the same time maintaining an opacity of at least 70% and a tensile strength above minimum commercial requirements. Also, a need exists for a method of producing such wrappers. A need also exists for a method of reducing basis weight without adversely interfering with other physical properties of the paper.

SUMMARY OF THE INVENTION

The present invention recognizes and addresses the foregoing disadvantages, and others of prior art constructions and methods.

In general, the present invention is directed to reduced basis weight wrapping papers for use in smoking articles that retain the opacity and tensile strength levels commercially required. According to the present invention, the reduced basis weight wrapping papers contain a white pigment and optionally a black pigment.

Accordingly, it is an object of the present invention to provide a reduced basis weight paper that can be used as an outer wrapper for smoking articles.

Another object of the present invention is to provide a wrapping paper for smoking articles having a reduced basis weight and maintaining an opacity of at least 70%.

It is another object of the present invention is to provide a wrapping paper for smoking articles having a reduced basis weight while maintaining a tensile strength above the minimum required for conventional wrapping paper.

Still another object of the present invention is to provide a method for producing reduced basis weight cigarette wrapping papers.

Yet another object of the present invention is to provide a wrapping paper for smoking articles having a reduced basis weight that contains a white pigment having a particle size that is roughly equal to one-half the wavelength of visible light, and optionally a small amount of a black pigment.

These and other objects of the present invention are achieved by providing a wrapping paper for a smoking article. The wrapping paper includes a paper substrate containing at least a first filler. The first filler comprises a white pigment having a median particle size of from about 0.1 microns to about 0.5 microns, and more particularly from about 0.2 microns to about 0.4 microns. Within this particle size range, the white pigment possesses more efficient light scattering characteristics than those used in the past.

Optionally, a second filler can be incorporated in to the paper wrapper. The second filler comprises a black pigment which can be present within the paper substrate in an amount up to about 2% by weight and particularly from about 0.1% to about 1.0% by weight.

The white pigment can be, for instance, precipitated calcium carbonate (PCC), titanium dioxide, or mixtures thereof, while the black pigment can be carbon, iron oxide, or mixtures thereof. The total filler content within the paper substrate can be from about 15% to about 40% by weight, and particularly from about 20% to about 30% by weight.

Conventional wrapping paper has a typical basis weight of about 25 $g/m^2$ to 26 $g/m^2$. The wrapping paper made in accordance with the present invention can have a basis weight from about 14 g/m$^2$ to about 22 g/m$^2$, and in particular from about 17 g/m$^2$ to about 20 g/m$^2$. The permeability of wrapping papers made in accordance with the present invention can be from about 5 Coresta units to about 80 Coresta units, and in particular from about 15 Coresta units to about 55 Coresta units.

Through the use of the fillers described above, paper wrappers can be made having a reduced basis weight while maintaining an acceptable opacity and tensile strength. In particular, the fillers are incorporated into the paper in a manner so as to maintain the opacity of the paper in amount of at least 70%. The tensile strength of the paper, on the other hand, should be at least 1800 g/29 mm, and particularly at least 2000 g/29 mm.

The present invention is also directed to smoking articles containing a column of smokable filler. The column of smokable filler is surrounded by a reduced basis weight wrapping paper as described above.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to accompanying figures, in which.

DETAILED DESCRIPTION OF PREFERRED EMBODIMENTS

Figure 1:
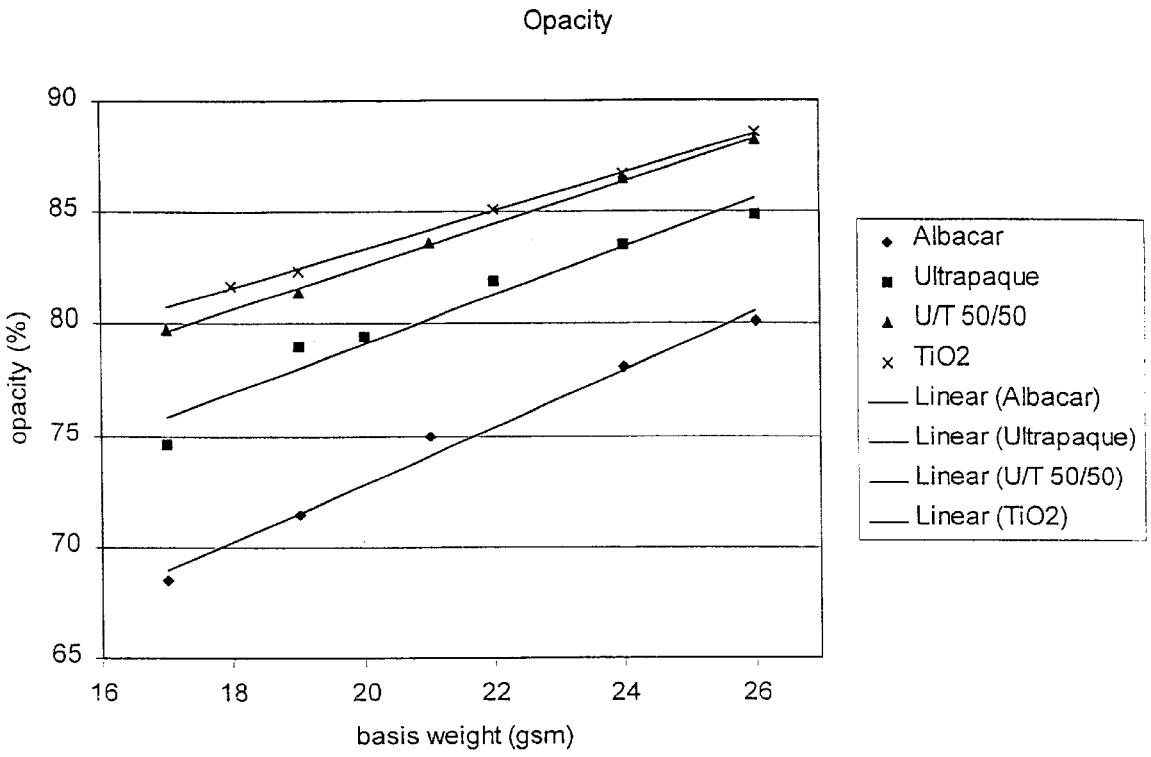
FIG. 1 is a graphical representation of the results obtained in the Example below.

It is to be understood by one of ordinary skill in the art that the present discussion is a description of exemplary embodiments only, and is not intended as limiting the broader aspects of the present invention which broader aspects are embodied in the exemplary construction.

The present invention is generally directed to reduced basis weight wrapping papers for smoking articles that maintain the minimum commercial requirements for opacity and tensile strength. The wrapping paper contains a white pigment and optionally a black pigment. The white pigment is effective in scattering light that contacts the paper. When present, the black pigment, on the other hand, absorbs light. Since the fillers are very efficient at scattering and absorbing light, wrapping papers can be produced with a basis weight below conventional levels without sacrificing various characteristics of the paper.

In the past, reducing the basis weight of conventional wrapping papers used in smoking articles caused the opacity to decrease significantly. Specifically, in order to keep tensile strength acceptable, the filler level had to be decreased and hence opacity decreased. Conventional wrapping papers are comprised of a filler, such as, for instance, precipitated calcium carbonate (PCC), which has a scalenohedral crystal structure and a particle size of about 2 micrometers. According to the present invention, using fillers which are more efficient at scattering light allows a reduction in the basis weight of the wrapping papers while maintaining the opacity and tensile strength above the minimum requirements. In particular, wrapping papers of the present invention can have a basis weight of less than about 22 gsm, which is a significant improvement over conventional cigarette wrapping papers which typically have a basis weight of about 25 gsm to 35 gsm. In fact, wrappers made in accordance with the present invention can even have a basis weight as small as 14 gsm and particularly from about 17 gsm to about 20 gsm.

It has been discovered that white pigments having a particular particle size within a selected range not only maintain opacity in reduced basis weight wrapping papers, but also allow a reduction in the amount of filler that is needed in the papers, which results in tensile strength levels above the minimum requirements. In general, adding greater amounts of fillers to wrapping papers in relation to the amount of cellulosic fibers present in the paper tends to decrease the strength of the paper. Through the process of the present invention, however, the amount of fillers added to the paper is minimized thus maintaining the tensile strength of the paper. Also, the whiteness and brightness are maintained consistent with conventional levels by using white pigments with a particle size within a selected range.

Specifically, the white pigments incorporated into the wrapping paper of the present invention should have a median particle size of from about 0.1 microns to about 0.5microns, and particularly from about 0.2 microns to about 0.4 microns. It is believed that the opacity, whiteness and brightness of a wrapping paper incorporating a white pigment within the above defined size range are increased due in part to the fact that the particle size of the pigment corresponds approximately to one-half the wavelength of visible light. Within this particle size range, it is believed that the white pigment is more effective in scattering light, providing the optical benefits. This allows for a reduction in the basis weight of the wrapping papers without sacrificing the opacity of the papers.

In one embodiment, the white pigment incorporated into the wrapping paper of the present invention is calcium carbonate having a particle size of from about 0.1 micron to about 0.5 micron. For instance, in one preferred embodiment, a calcium carbonate pigment marketed under the name ULTRAPAQUE by Specialty Minerals, Inc. of Adams, Mass. is used. ULTRAPAQUE is a precipitated calcium carbonate filler having a median particle size of about 0.3 micron. The calcium carbonate particles have a rhombohedral shape/morphology and have a surface area of approximately 7.5 m$^2$/g. ULTRAPAQUE is commercially available as a slurry containing approximately 40% by weight solids or as a dry powder. The slurry or dry powder can be added directly to the cellulosic fibers during the paper making process. As used herein the particle size of a filler is measured and determined by a sedimentation procedure using, for instance, a Sedigraph.

Besides calcium carbonate, it is believed that other white pigments having a particle size within the above defined range can similarly be used to construct wrapping papers made according to the present invention. For example, titanium dioxide has been found to produce the same effects as that of calcium carbonate on wrapping papers when having a particle size as described above. For instance, one commercially available titanium dioxide that may be used in accordance with the present invention is UNITANE O-110 pigment, marketed by Kemira, Inc. of Savannah, Ga. UNITANE O-110 is an anatase titanium dioxide pigment that has a particle size of approximately 0.25 microns.

Other white pigments that can be used in the present invention include, without limitation, magnesium oxides and other similar pigments. Further, different types of fillers can be combined if desired.

Besides a white pigment, wrapping papers made in accordance with the present invention can optionally also contain small amounts of a black pigment. The black pigment can be added in amounts sufficient to increase the opacity of the paper without substantially decreasing the whiteness and brightness of the paper.

The black pigment used in combination with the white pigment according to the present invention can be, for instance, carbon, such as an activated carbon, a black iron oxide, or mixtures thereof. The particle size of the black pigment is generally less critical. For instance, in most applications, the particle size of the black pigment can be up to approximately 10 microns or less. The black pigment should be added to the paper in combination with the white pigment in an amount so as not to decrease the brightness of the paper below acceptable levels. In general, the brightness of the paper when containing the black pigment should be at least about 70% as measured by the TAPPI method. Preferably, the paper should have a brightness level of from about 70% to about 80%.

Similarly, the black pigment should be added to the paper so as not to decrease the whiteness of the paper below conventional levels. For instance, the wrapping paper of the present invention should have an L value of at least about 80% in most applications. The L value is a measure of paper whiteness on the Hunter color scale and is measured using a spectrophotometer, such as a TCS II spectrophotometer. More particularly, the L value of a wrapping paper made according to the present invention can have an L value of from about 80% to about 90%.

Thus far, when calcium carbonate, titanium dioxide or mixtures thereof are used as the white pigment and either carbon or iron oxide is used as the black pigment, the black pigment can be added to the wrapping paper in an amount up to about 2% by weight, and particularly from about 0.1% to about 1.0% by weight based on the total weight of the paper. According to the present invention, a black pigment may be incorporated into a wrapping paper within the above weight range without decreasing the whiteness or brightness of the paper below the above described levels.

Another significant advantage to the present invention is that the opacity of wrapping paper can be maintained when the basis weight of the paper is reduced without increasing the total filler levels within the paper. In fact, the proportionate amount of filler added to the paper can be decreased which helps maintain the tensile strength of the paper when the basis weight is decreased. Wrappers made according to the present invention can have a total filler level, which includes the weight of the white and black pigments, of between about 15% to about 40%, and particularly between about 20% and 30% by weight.

In one preferred embodiment, calcium carbonate having a particle size of from about 0.1 micron to about 0.5 micron is added to the wrapping paper in an amount from about 20% to about 30% by weight in combination with a black pigment in an amount up to about 2% by weight. Within these ranges, the opacity of the wrapping paper and the tensile strength were both maintained above the minimum requirements when the basis weight of the paper was reduced. Also, the reduction in basis weight had no effects on any other physical properties of the paper, such as the permeability of the paper.

The fiber furnish used to make wrapping papers in accordance with the present invention can include cellulosic fibers obtained, for instance, from flax, soft wood or hard wood. In order to vary the physical properties of the paper, different mixtures of fibers may be used and the amount of refinement of the papers may be varied without affecting the attributes of the present invention.

The permeability of paper wrappers made according to the present invention can be generally from about 5 Coresta units to about 80 Coresta units. In most applications, the permeability should be between about 15 Coresta units to about 55 Coresta units.

The wrapping papers may also be treated with a burn control additive. Such burn control additives can include, for instance, alkali metal salts, acetates, phosphate salts or mixtures thereof. A particularly preferred burn control additive is a mixture of potassium citrate and sodium citrate. The burn control additive can be added to the paper in an amount from about 0.3% to about 12% by weight, and more particularly between about 0.3% to about 3% by weight.

The white and black pigments of the present invention may be incorporated into the paper wrapper according to various known methods. For instance, in one embodiment, the pigments can be combined in a slurry and added to a suspension of cellulosic fibers when forming the paper.

The present invention may be better understood with reference to the following example.

EXAMPLE

In order to demonstrate the present invention, four hand sheets were made incorporating into the paper a white pigment. In one set of hand sheets (which represent the control), the white pigment incorporated into the paper was ALBACAR 5970 calcium carbonate filler, a conventionally used filler having a median particle size of about 1.9 microns. The ALBACAR 5970 filler, which was obtained from Specialty Minerals, Inc. of Adams, Mass. was incorporated into the paper in an amount of 30% by weight. In a second set of hand sheets instead of ALBACAR 5970 filler, UTRAPAQUE calcium carbonate particles also obtained from Specialty Minerals, Inc., having a mean particle size of about 0.3 micron, were added to the paper in accordance with the present invention. The ULTRAPAQUE filler was added to the paper in an amount of 30% by weight.

In a third set of hand sheets, a 50/50 blend of ULTRAPAQUE and titanium dioxide were added to the paper in accordance with the present invention. The titanium dioxide filler was UNITANE O-110 obtained from Kemira, Inc. of Savannah, Ga, which has a particle size of approximately 0.25 microns. The 50/50 blend filler was added to the paper in an amount of 30% by weight. Finally, in a fourth set of hand sheets, titanium dioxide (unitane 110-1) was added to the paper in accordance with the present invention. The titanium dioxide filler was also added to the paper in an amount of 30% by weight.

The basis weight of each set of hand sheets was varied from 17 gsm to 26 gsm. Each hand sheet produced was made from flax refined 12 thousand revolutions in a PFI mill.

FIG. 1 illustrates opacity levels as the basis weight of the hand sheets were increased. From FIG. 1, it can be seen that when the ALBACAR filler was added to the paper, the opacity level was much lower than any of the other fillers tested. The use of titanium dioxide filler or the 50/50 blend of ULTRAPAQUE and titanium dioxide produced very similar results with the opacity level remaining very high even at the lowest basis weight of 17 gsm. All of the hand sheets made according to the present invention had an opacity of at least 70% at the lowest basis weight.

Further machine-made paper was produced in order to compare the performance of ALBACAR 5970 filler in a paper at a conventional basis weight level versus UTRAPAQUE filler in lower basis weight paper. Specifically, Table 1 below compares reduced basis weight cigarette papers against the control paper. The control paper contained the ALBACAR 5970 as the filler, while the trial versions contained the ULTRAPAQUE filler in accordance with the present invention. The papers produced were tested for opacity and machine direction tensile strength. The tensile strength test, which was performed on samples that had a width of 29 mm, was conducted on an Instron instrument.

TABLE 1

| Property | Control | Trial #1 | Trial #2 | Trial #3 | Trial #4 |
|---|---|---|---|---|---|
| Basis Weight ($g/m^2$) | 25 | 23½ | 21½ | 20 | 19 |
| CORESTA permeability | 24 | 15 | 21 | 52 | 32 |
| Opacity % | 74 | 76½ | 74 | 71½ | 72 |
| MD Tensile Strength (g/29 mm) | 3,100 | 3,000 | 2,700 | 2,400 | 2,500 |
| Chalk (%) | 28 | 25 | 23 | 25 | 25 |

Even at the lowest basis weight using the ULTRAPAQUE filler, the opacity level and tensile strength was only marginally lower than that of the control paper containing ALBACAR 5970. From these results, it can be seen that the basis weight of wrapping papers can be decreased and the proportionate amount of fillers added to the papers can be decreased while maintaining opacity levels and tensile strength levels above the minimum requirements.

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole or in part. Furthermore those of ordinary skill in the art will appreciate that the foregoing description is by way of example only, and is not intended to limit the invention so further described in such appended claims.

What is claimed is:

1. A wrapping paper for a smoking article comprising:

a paper substrate containing a filler, said filler comprising a white pigment having a median particle size of from about 0.1 microns to about 0.5 microns, said wrapping paper having an opacity of at least 80% and a brightness of at least 70% and a basis weight of up to about 22 gsm, wherein said paper has a tensile strength of at least about 1800 g/29 mm.

2. A wrapping paper as defined in claim 1, wherein said white pigment comprises calcium carbonate.

3. A wrapping paper as defined in claim 1, wherein said white pigment comprises titanium dioxide.

4. A wrapping paper as defined in claim 1, wherein said white pigment comprises a mixture of calcium carbonate and titanium dioxide.

5. A wrapping paper as defined in claim 1, wherein said white pigment is present within said paper substrate in an amount from about 15% to about 30% by weight.

6. A wrapping paper as defined in claim 1, wherein said white pigment has a median particle size of from about 0.2 microns to about 0.4 microns.

7. A wrapping paper as defined in claim 1, wherein said paper substrate has a basis weight of less than about 20 gsm.

8. A wrapping paper as defined in claim 1, further comprising a burn control additive coated onto said paper substrate, said burn control additive being a material selected from the group consisting of alkali metal salts, acetates, phosphate salts, and mixtures thereof.

9. A wrapping paper as defined in claim 1, further comprising a black pigment, said black pigment being present within said paper substrate in an amount up to about 2% by weight.

10. A wrapping paper as defined in claim 9, wherein said black pigment comprises a material selected from the group consisting of carbon, iron oxide, and mixtures thereof.

11. A wrapping paper as defined in claim 1, wherein said wrapping paper has a brightness of least 70% and an L value of at least 80%.

12. A wrapping paper as defined in claim 1, wherein said paper substrate has a permeability of from about 15 Coresta units to about 55 Coresta units.

13. A wrapping paper as defined in claim 1, wherein said paper has a tensile strength of at least 2000 g/29 mm.

14. A method for making a wrapping paper for a smoking article having a reduced basis weight comprising the steps of:

incorporating into a paper substrate a filler comprising a white pigment, said white pigment having a median particle size of from about 0.1 microns to about 0.5 microns, said white pigment being added to said paper substrate in an amount from about 15% to about 35% by weight; and wherein said white pigment is added to said wrapping paper in an amount sufficient to increase the opacity of said wrapping paper up to at least about 70%, while maintaining the basis weight of said wrapping paper below about 22 gsm, wherein said paper has a tensile strength of at least about 1800 g/29 mm.

15. A method as defined in claim 14, wherein said wrapping paper has a brightness of at least about 70% and an L value of at least about 80%.

16. A method as defined in claim 14 wherein said white pigment comprises calcium carbonate.

17. A method as defined in claim 14, wherein said white pigment comprises titanium dioxide.

18. A method as defined in claim 14, wherein said white pigment comprises a mixture of calcium carbonate and titanium dioxide.

19. A method as defined in claim 14, wherein said white pigment has a median particle size of from about 0.2 microns to about 0.4 microns.

20. A method as defined in claim 14, wherein said wrapping paper has a basis weight of up to about 20 gsm.

21. A method as defined in claim 15, further comprising the step of incorporating a black pigment into said paper substrate, said black pigment being added in amount up to about 2% by weight.

22. A method as defined in claim 20, wherein said black pigment comprises a material selected from the group consisting of carbon, iron oxide, and mixtures thereof, said black pigment having a medium particle size of less than about 10 microns.

23. A method as defined in claim 20, wherein said wrapping paper has a brightness of at least about 70% and an L value of at least about 80%.

24. A method as defined in claim 22, wherein said white pigment has a medium particle size of from about 0.2 microns to about 0.4 microns.

25. A method as defined in claim 14, wherein said wrapping paper has a tensile strength of at least 2000 g/mm.

26. A smoking article comprising:

a column of a smokable filler; and a wrapping paper surrounding said column of said smokable filler, said wrapping paper comprising a paper substrate containing calcium carbonate, titanium dioxide, or mixtures thereof having a median particle size of from about 0.2 microns to about 0.4 microns, said wrapping paper having a basis weight of up to about 22 gsm, a permeability of from about 15 Coresta units to about 55 Coresta units, a total filler content of from about 15% to about 35% by weight, and an opacity of at least about 70%, wherein said paper has a tensile strength of at least about 1800 g/29 mm.

27. A smoking article as defined in claim 26, wherein said paper substrate further comprises, a black pigment, said black pigment being present within said substrate in an amount from about 0.1% to about 1% by weight.

28. A smoking article as defined in claim 27, wherein said wrapping paper has a brightness of at least about 70% and an L value of at least about 80%.

29. A smoking article as defined in claim 26, wherein said wrapping paper has a basis weight of up to about 20 gsm.

30. A smoking article as defined in claim 26, wherein said wrapping paper has a basis weight of up to about 19 gsm.

31. A smoking article as defined in claim 26, wherein said wrapping paper has a basis weight of up to about 17 gsm.

32. A smoking article as defined in claim 26, wherein said wrapping paper has a tensile strenth of at least 2000 g/mm.

* * * * *